US006050054A

United States Patent [19]

Van Lierde et al.

[11] Patent Number: 6,050,054

[45] Date of Patent: Apr. 18, 2000

[54] MAIL ITEM FEED DEVICE

[75] Inventors: Olivier Van Lierde, Bourg la Reine; Alain Philippe, Saint Pathus, both of France

[73] Assignee: Neopost Industrie, Bagneux, France

[21] Appl. No.: 09/015,529

[22] Filed: Jan. 29, 1998

[30] Foreign Application Priority Data

Jan. 31, 1997 [FR] France ..... 97 01052

[51] Int. Cl.[7] ..... B65B 65/02

[52] U.S. Cl. ..... 53/284.3; 53/460; 271/171; 271/223; 271/262; 271/277

[58] Field of Search ..... 53/284.3, 460, 53/569; 271/144, 171, 223, 253, 258.01, 262, 263, 270, 277

[56] References Cited

U.S. PATENT DOCUMENTS

| | | | |
|---|---|---|---|
| 4,850,580 | 7/1989 | Denzin et al. | 271/2 |
| 4,930,764 | 6/1990 | Holbrook et al. | 271/119 |
| 5,203,263 | 4/1993 | Berger et al. | 101/76 |
| 5,203,846 | 4/1993 | Kuhns et al. | 271/125 |
| 5,431,385 | 7/1995 | Holbrook | 271/122 |
| 5,441,253 | 8/1995 | Takemoto et al. | 271/34 |
| 5,456,457 | 10/1995 | Kerstein et al. | 271/10.07 |
| 5,460,362 | 10/1995 | Fassman et al. | 271/264 |
| 5,584,476 | 12/1996 | Marzullo et al. | 271/126 |
| 5,628,504 | 5/1997 | Lyga | 271/171 |
| 5,809,752 | 9/1998 | Holbrook | 53/569 |
| 5,833,229 | 11/1998 | Prim | 271/11 |

FOREIGN PATENT DOCUMENTS

| | | |
|---|---|---|
| 0 542 550 A1 | 5/1993 | European Pat. Off. . |
| 0 591 526 A1 | 4/1994 | European Pat. Off. . |

*Primary Examiner*—Joseph J. Hail, III
*Assistant Examiner*—William Hong
*Attorney, Agent, or Firm*—Sughrue, Mion, Zinn, Macpeak & Seas, PLLC

[57] ABSTRACT

A mail item feed device adapted to be mounted on the upstream side of a franking machine and including in succession along a mail item transport path, a first or mail item feed area for receiving a stack of mail items, a second or mail item selection and transport area including a selector and transport module for separating the items one by one from the stack, and possibly a third or mail item closing area including a closing module for closing the mail items, the selector and transport module including independent selector means including selector rollers for separating the mail items one by one from the feed area and transport means including at least one set of transport rollers co-operating with the conveyor means in the selection and transport area to transport the mail items separated in this way towards an area farther downstream, and manual release means additionally being provided for raising the selector rollers if the mail items have a thickness greater than a predetermined thickness. In the event of a jam, the same manual release means are also used to raise the transport rollers and so provide free access to the transport path.

9 Claims, 4 Drawing Sheets

10
12
14
16
18
20
22
24
26
28

MAIL ITEM FEED DEVICE

FIELD OF THE INVENTION

The present invention relates to the field of mail processing and is more particularly concerned with a device for feeding a postage meter (or "franking machine") with thick mail items.

PRIOR ART

A franking machine must conventionally be adapted to receive different types of mail items such as documents, letters, or envelopes of greater or lesser thickness. To this end it often includes, on the upstream side of the entry slot for mail items, a feed device for conveying envelopes at various speeds with the flap in the folded down position or in the open position. That automatic feed device usually includes means for receiving/stacking, selecting, transporting, and possibly closing the mail items to be processed.

U.S. Pat. No. 4,850,580 discloses an automatic feeder of the above kind that includes a selector module that can be retracted to feed thick mail items manually. It is therefore not possible to close this type of mail item automatically, which is a significant limitation on performance. Furthermore, in that type of feeder jams cannot be cleared easily and quickly, despite the retractable module.

OBJECT AND DEFINITION OF THE INVENTION

The object of the present invention is to overcome the above drawbacks by proposing a mail item feed device designed to be placed on the upstream side of a franking machine to facilitate feeding the machine with thick mail items and possibly to enable jams to be cleared by simple and fast access to the mail item transport path.

These aims are achieved by a mail item feed device adapted to be mounted on the upstream side of a franking machine and including in succession along a mail item transport path a first or mail item feed area for receiving a stack of mail items, a second or mail item selection and transport area including a selector and transport module for separating the items one by one from the stack and possibly a third or mail item closing area including a closing module for closing said mail items, wherein said selector and transport module includes independent selector means including selector rollers for separating the mail items one by one from the feed area and transport means including at least one set of transport rollers co-operating with conveyor means in the selection and transport area to transport the mail items separated in this way towards the closing area (or directly to the entry of the franking machine), manual release means additionally being provided for raising said selector rollers if the mail items have a thickness greater than a predetermined thickness.

Because of this specific structure it is possible to introduce thick mail items into the feed device without compromising the operation of the franking machine disposed on its downstream side that continues to be fed automatically by the transport (and optionally closing) mechanism of the feed device.

The manual release means are further designed so that, in the event of a jam, said transport rollers can also be raised to provide totally free access to the transport path. To this end, the selector rollers and the transport rollers are attached to each other by means of an articulated assembly that can be maneuvered directly from the manual release means.

The articulated assembly that is pivoted by the manual release means preferably includes a friction member adapted to co-operate with a corresponding member of said manual release means. It includes a plate that can pivot, like a swing, around a rotation shaft mounted between two longitudinal walls disposed on respective opposite sides of the transport path, one of the two ends of this plate carrying a first support shaft coupled to the selector rollers and the other end carrying a second support shaft coupled to the transport rollers.

The first support shaft is coupled to the selector rollers by a cylindrical tube including first spring means and the second support shaft is coupled to the transport rollers by levers articulated to the ends of the arm supporting the transport rollers.

The support arms advantageously have a very open V shape and a pivot pin fixed between the longitudinal walls passes through their middle.

The second end of the plate preferably further terminates in a hook-shaped part adapted to receive and raise an attachment shaft to which a first end of the spring means is fixed, the second end of the spring means being coupled to said support arms by said levers.

BRIEF DESCRIPTION OF THE DRAWINGS

Other features and advantages of the present invention will become more apparent from the following description given by way of non-limiting example with reference to the appended drawings, in which.

DETAILED DESCRIPTION OF A PREFERRED EMBODIMENT OF THE INVENTION

Figure 1:
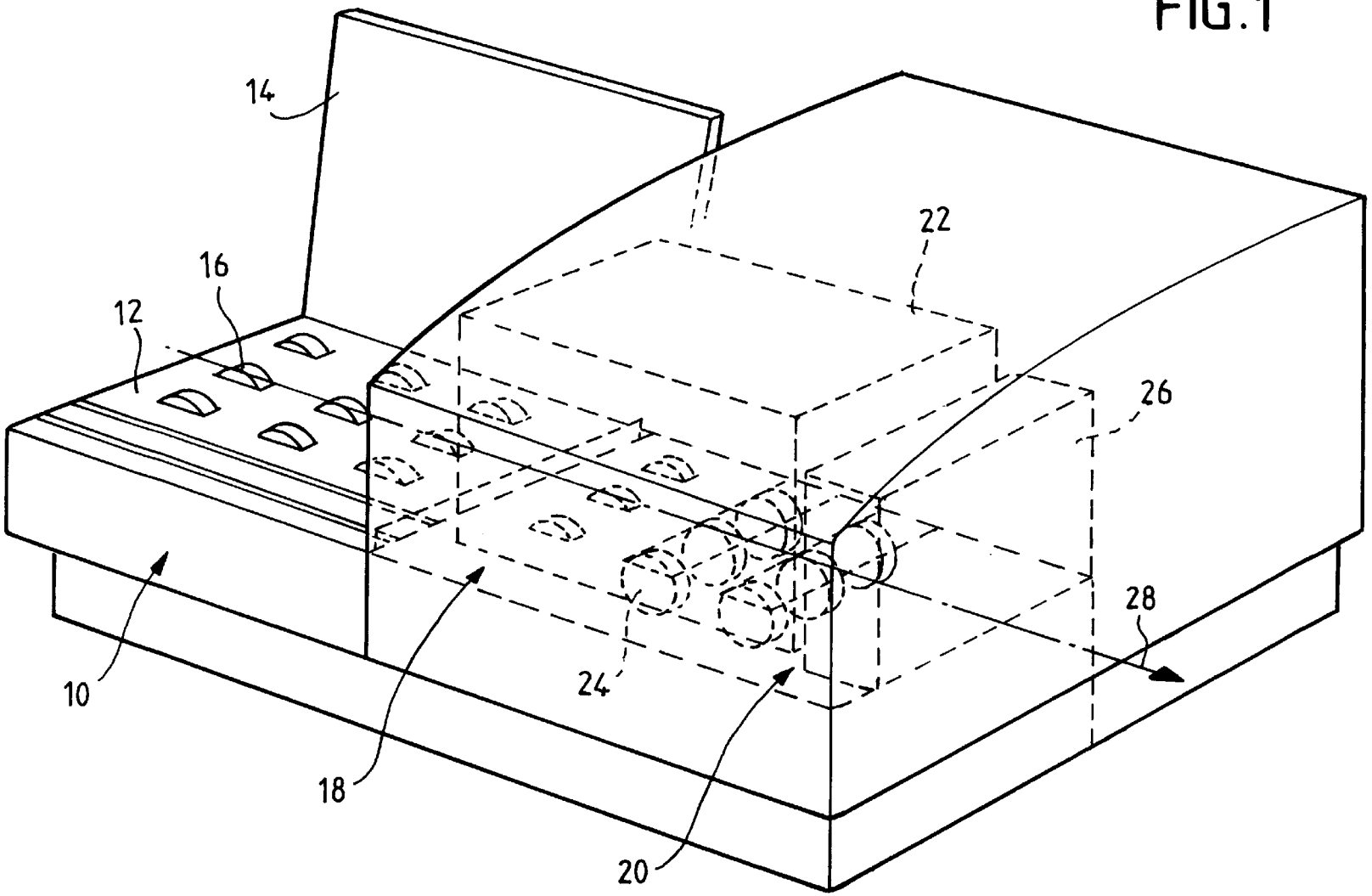
FIG. 1 is a perspective view of a mail item feed device of the invention.

The mail item feed device from FIG. 1 includes a feed area 10 essentially formed of a plate 12 and a mobile lateral wall 14 and adapted to receive a stack of mail items having flaps that may be folded down or open. This area includes first transport means including a plurality of rollers 16 for moving the mail items in the downstream direction into a separation and transport area 18 including a separator and transport module 22 and in which these items are extracted one by one from the stack. Second transport means including a plurality of conveyor rollers 24 are of course also provided in this separation and transport area to transfer the mail items extracted in this way further in the downstream direction, for example towards an area 20 for closing the mail items including a closing (and moistening and sticking, for example) module 26, if the feed device includes these facilities. The gap between the second transport means and the separator and transport module defines a transport path 28 for the mail items. The feed device further includes various control and monitoring means known in themselves (not shown) necessary for its operation (in particular for driving the various rollers for feeding the mail items) and which there is no need to describe in more detail.

Figure 2:
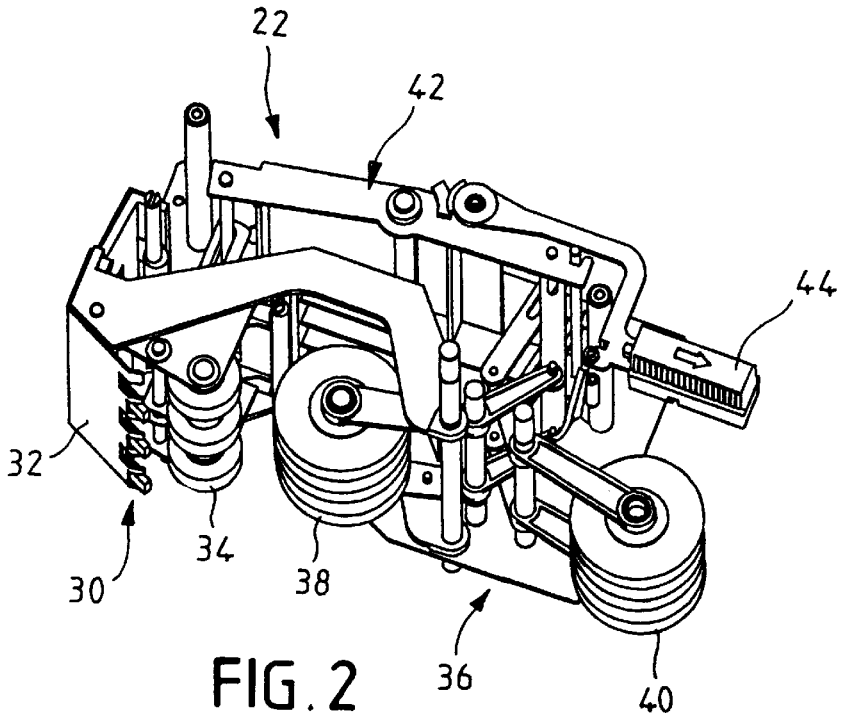
FIG. 2 is a bottom perspective view of the selector and transport module of the device from FIG. 1.
Figure 3:
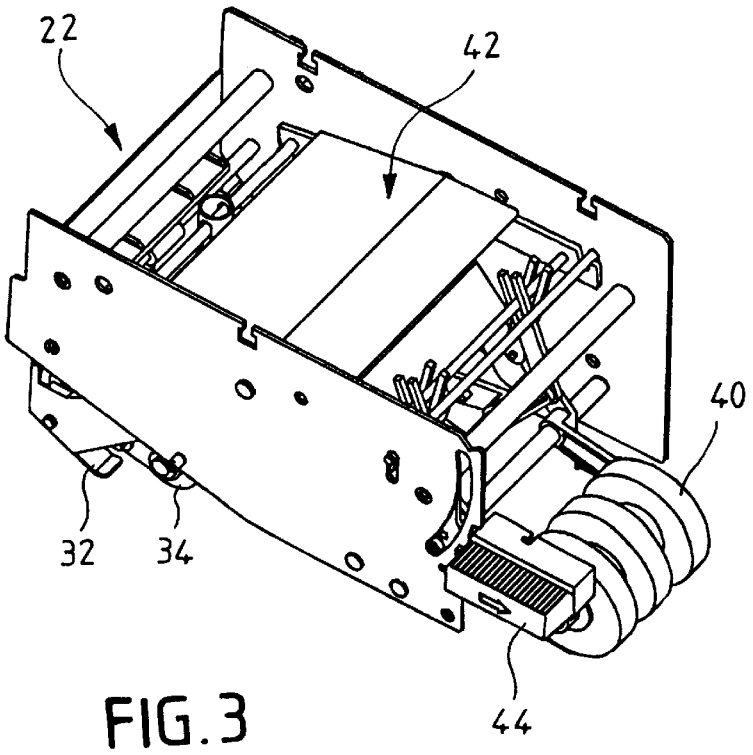
FIG. 3 is a top perspective view of the selector and transport module of the device from FIG. 1.

FIGS. 2 and 3 show the structure of the separator and transport module 22. The latter includes in succession, in the direction of advance of a mail item along the transport path 28, a selector mechanism 30 with a throat 32 and selector rollers 34, and a transport mechanism 36 with front and rear transport rollers 38, 40. The selector rollers and the two sets of transport rollers are adapted to co-operate with the conveyor rollers 24 of the selection and transport area 18 to select a single mail item and to transport it to the closing module 26 or to the entry of the franking machine if the feed device does not include a closing module. The two mechanisms of the selection and transport module 22 are fastened together by an articulated assembly 42 which can be pivoted by a single operating lever 44 to disengage the transport path 28 by moving the rollers of this module away from the conveyor rollers.

Figure 4:
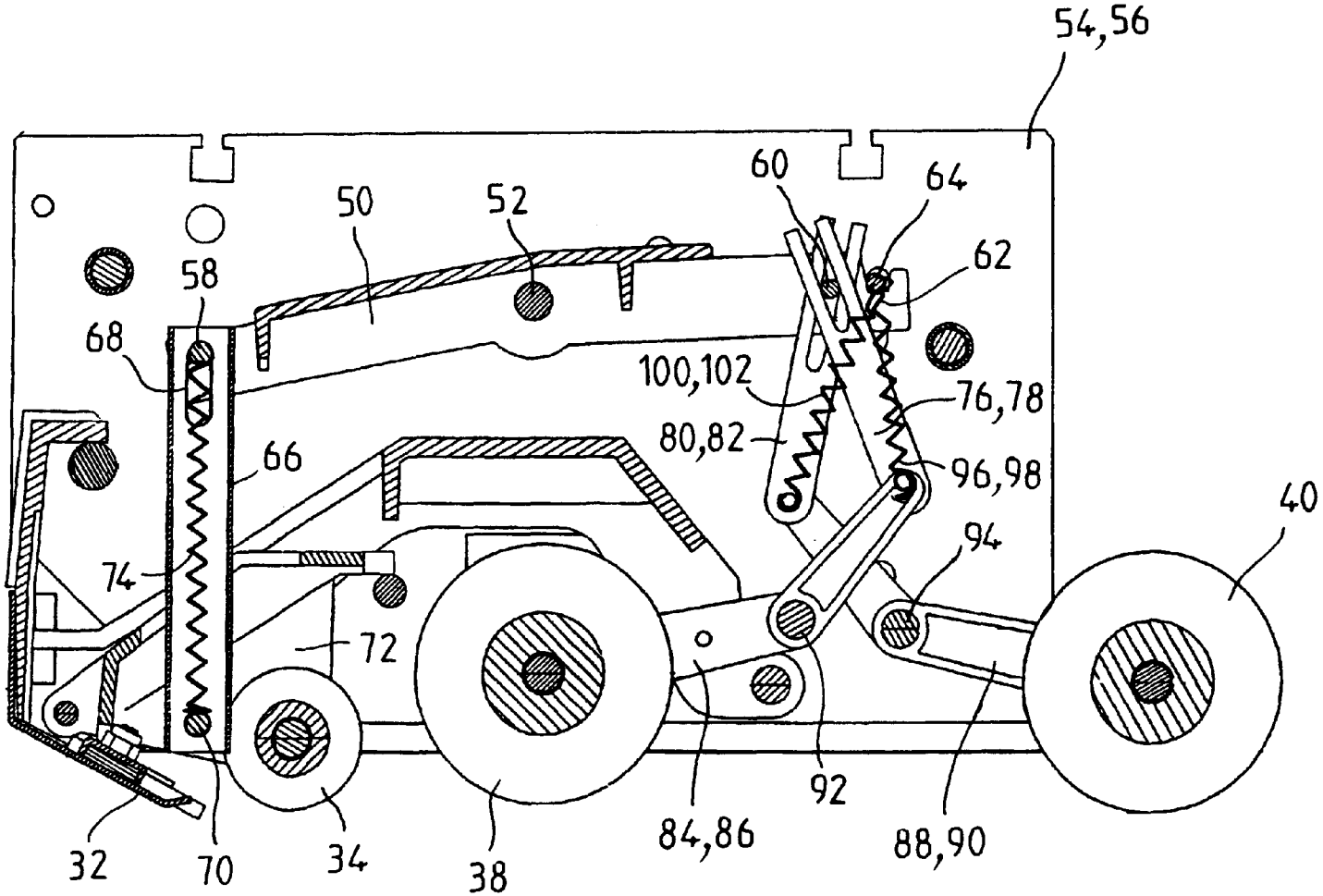
FIG. 4 is a view of the selector and transport module from FIGS. 2 and 3 in longitudinal section.
Figure 5:
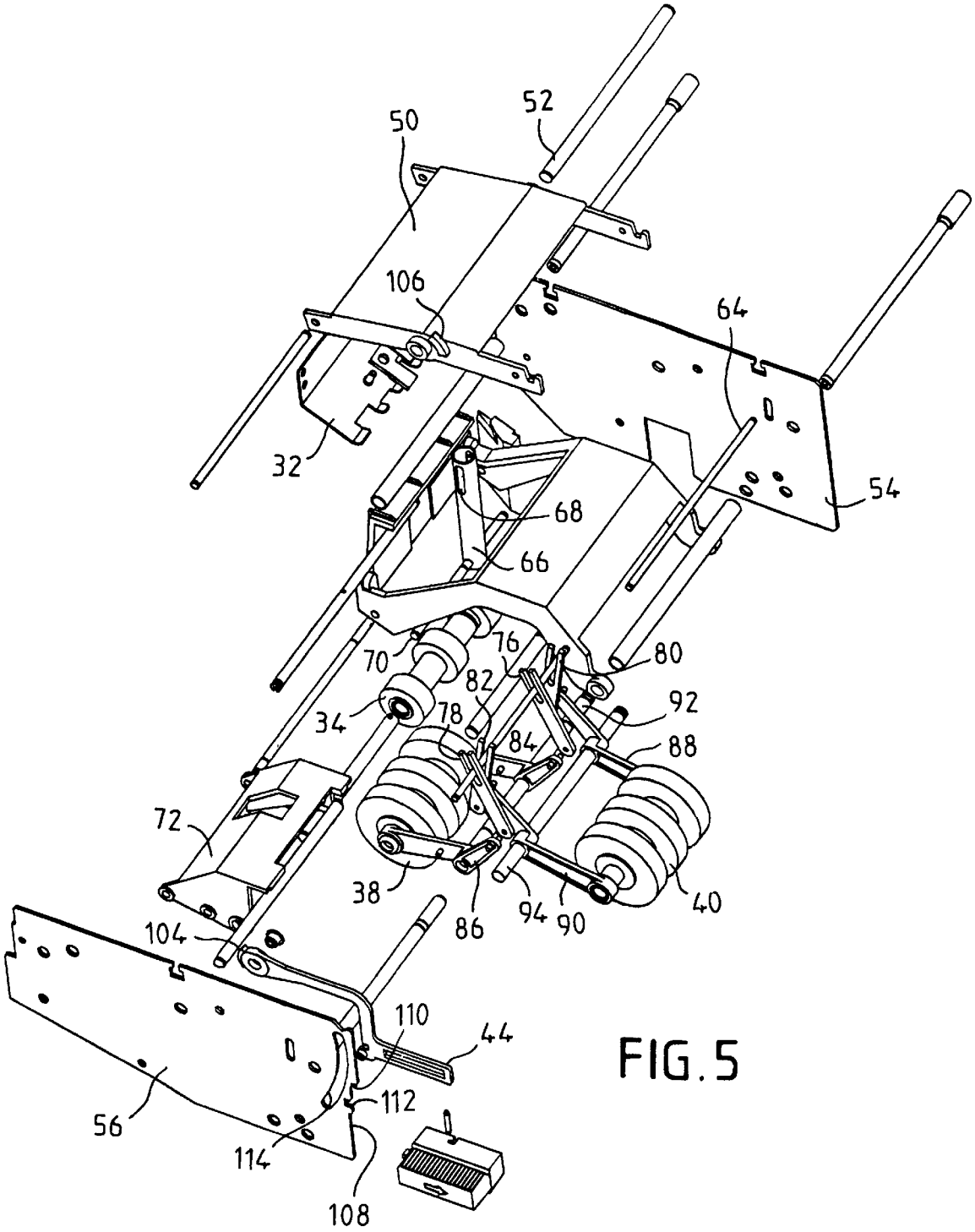
FIG. 5 is an exploded perspective view of the selector and transport module of the feed device of the invention.

The articulated assembly 42 is described next with reference to FIGS. 4 and 5 which are respectively a longitudinal section and an exploded perspective view of the module from FIGS. 2 and 3. This assembly includes a plate 50 which can pivot like a swing about a rotation shaft 52 passing through its center of gravity and mounted between two longitudinal walls 54, 56 on respective opposite sides of the transport path 28. A first support shaft 58 transverse to this path is fixed to one of the two ends of this plate and a transverse second support shaft 60 is fixed to its other end. Furthermore, this second end terminates in a hook-shaped part 62 adapted to receive and to raise an attachment shaft 64 when the plate 50 pivots. The middle of the first support shaft 58 passes through a slot 68 in a first end of a cylindrical tube 66. A support shaft 70 fastened to the selector rollers 34 by a reinforcing member 72 passes through the other end of the tube 66. The tube 66 further contains first spring means, such as a spring 74, held between the first support shaft 58 and the retaining shaft 70 and adapted to press the selector rollers perfectly onto the mail items. Forked first ends of four levers 76, 78, 80, 82 fit over the second support shaft 60 and their second ends pivot at the ends of four arms 84, 86, 88, 90 supporting the two sets of transport rollers 38, 40. A pivot pin 92, 94 fixed between the longitudinal walls 54, 56 passes through the middle of the two support arms of each set of transport rollers, which have a very open V shape, (a first end of this V receiving the shaft on which these rollers rotate and the second end receiving the pin on which the forks pivot). Second spring means, such as four springs 96, 98, 100, and 102, are mounted between the aforementioned attachment shaft 64 and the pivot pins of the four levers at the second ends of the support arms so that contact between the transport rollers and the conveyor rollers is maintained at all times when processing mail of standard thickness (i.e. less than a predetermined thickness).

The articulated assembly 42 is pivoted by the operating lever 44, one end of which advantageously includes a toothed sector 104 adapted to co-operate with a corresponding toothed sector 106 of the plate 50 (this contact can be seen in FIG. 2 which shows clearly the coupling between the operating lever 44 and the articulated assembly 42). This lever moves between an initial rest position 108 in which the plate 50 is substantially horizontal and the selector and transport rollers are in contact with the conveyor rollers 24, and an extreme position 110 in which the plate 50 is inclined and the rollers are entirely raised to provide free access to the transport path 28. An intermediate position 112 can be defined between these two positions that corresponds to mail items having a thickness greater than a predetermined thickness and in which the plate 50 is slightly inclined so that only the selector rollers 34 are raised. Note that guidance of the lever is facilitated by the presence of a slot 114 in the longitudinal wall 56.

The feed device operates as follows. In a normal mode, in which the operating lever 44 occupies its rest position, standard thickness mail items are stacked on the plate 12 of the feed area and are fed by the rollers 16 towards the separation and transport area 18 where they are successively extracted one by one and then transported (by the module 22 co-operating with the conveyor rollers 24) towards the closing module 26 before they are introduced into the franking machine proper. On the other hand, if there is a high risk of a thick mail item jamming the feed device it is possible for the operator, by way of a first manual action on the operating lever 44, to move it from its initial rest position to a first working position in which the selector mechanism 30 is raised to facilitate the introduction of this mail item into the separator and transport module 22 where it is taken up and transported towards the closing module 26 between the transport rollers 38, 40 and conveyor rollers 24. Note that with the structure of the invention only the selector mechanism is taken out of use, the other functions of the feed device (transporting and closing the processed mail item) remaining fully operational. Moreover, in the event of mail items jamming in this selector mechanism, it is equally possible by moving the same lever 44 to a second working position to raise not only the selector mechanism but also the transport rollers, so providing totally free access to the path 28.

With the structure of the invention, simple and particularly fast access (requiring only a single action on a lever) is possible to the transport path in the event of mail items jamming.

What is claimed is:

1. A mail item feed device adapted to be mounted on the upstream side of a franking machine and comprising in succession along a mail item transparent path:

a mail item feed area for receiving a stack of mail items;

a mail item selection and transport area including a selector and transport module for separating the mail items one by one from the stack; and a mail item closing area including a closing module for closing said mail items, wherein said selector and transport module includes:

independent selector means including selector rollers cooperating with corresponding rollers in the selection and transport area for separating the mail items one by one from the feed area, transport means including at least one set of transport rollers cooperating with conveyor means in the selection and transport area to transport the mail items separated in this way towards the closing area, and manual release means for raising said selector rollers if the mail items have a thickness greater than a predetermined thickness wherein the selector rollers and the transport rollers are fastened together by an articulated assembly which includes a plate that can pivot like a swing about a rotation shaft mounted between two longitudinal walls disposed on respective opposite sides of the transport path one of the two ends of this plate carrying a first support shaft coupled to the selector rollers and its other end carrying a second support shaft coupled to the transport rollers.

2. A mail item feed device adapted to be mounted at the upstream end of a franking machine and comprising in succession along a mail item transport path:

a mail item feed area for receiving a stack of mail items; and a mail item selection and transport area including a selector and transport module for separating the items one by one from the stack and transporting them in the downstream direction towards the franking machine, wherein said selector and transport module includes:

independent selector means including selector rollers cooperating with corresponding rollers in the selection and transport area for separating the mail items one by one from the feed area;

transport means including at least one set of transport rollers co-operating with conveyor means in the selection and transport area to transport the mail items separated in this way towards an entry of the franking machine; and manual release means for raising said selector rollers if the mail items have a thickness greater than a predetermined thickness wherein the selector rollers and the transport rollers being fastened together by an articulated assembly which includes a plate that can pivot like a swing about a rotation shaft mounted between two longitudinal walls disposed on respective opposite sides of the transport path one of the two ends of this plate carrying a first support shaft coupled to the selector rollers and its other end carrying a second support shaft coupled to the transport rollers.

3. A feed device according to claims 1 or 2, wherein said manual release means are further adapted also to raise said transport rollers in the event of a jam to provide totally free access to the transport path.

4. A feed device according to claims 1 or 2, wherein the articulated assembly which is pivoted by the manual release means includes a toothed sector adapted to co-operate with a corresponding toothed sector of said manual release means.

5. A feed device according to claims 1 or 2, wherein the first support shaft is coupled to the selector rollers by a cylindrical tube including first spring means.

6. A feed device according to claim 5, wherein said support arms have a very open V shape and a pivot pin fixed between the longitudinal walls passes through their middle.

7. A feed device according to claims 1 or 2, wherein the second support shaft is coupled to the transport rollers by levers articulated to the ends of arms supporting said transport rollers.

8. A feed device according to claims 1 or 2, wherein the second end of the plate further terminates in a hook-shaped part adapted to receive and to raise an attachment shaft to which is fixed a first end of spring means, the second end of said spring means being coupled to said support arms by said levers.

9. A mail item feed device adapted to be mounted at the upstream end of a franking machine and comprising in succession along a mail item transport path:

a mail item feed area for receiving a stack of mail items; and a mail item selection and transport area including a selector and transport module for separating the items one by one from the stack and transporting them in the downstream direction towards the franking machine, wherein said selector and transport module includes:

independent selector means including selector rollers cooperating with corresponding rollers in the selection and transport area for separating the mail items one by one from the feed area;

transport means including at least one set of transport rollers co-operating with conveyor means in the selection and transport area to transport the mail items separated in this way towards an entry of the franking machine; and manual release means for raising said selector rollers if the mail items have a thickness greater than a predetermined thickness, wherein the selector rollers and the transport rollers are fastened together by an articulated assembly operable directly from the manual release means, and wherein the articulated assembly which is pivoted by the manual release means includes a toothed sector adapted to co-operate with a corresponding toothed sector of said manual release means.

* * * * *